US011575989B1

(12) United States Patent
Li

(10) Patent No.: US 11,575,989 B1
(45) Date of Patent: Feb. 7, 2023

(54) METHOD OF SUPPRESSING WIND NOISE OF MICROPHONE AND ELECTRONIC DEVICE

(71) Applicant: Samsung Electronics Co., Ltd., Suwon-si (KR)

(72) Inventor: Yanhong Li, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 17/503,668

(22) Filed: Oct. 18, 2021

(30) Foreign Application Priority Data

Sep. 23, 2021 (CN) ..... 202111116519.2

(51) Int. Cl.

| | |
|---|---|
| ***H04R 3/04*** | (2006.01) |
| ***H04R 5/033*** | (2006.01) |
| ***H04R 5/04*** | (2006.01) |
| ***G10K 11/178*** | (2006.01) |
| ***G10L 21/0216*** | (2013.01) |
| ***G10L 21/0232*** | (2013.01) |
| ***G10L 25/90*** | (2013.01) |
| ***G10L 25/84*** | (2013.01) |

(52) U.S. Cl.
CPC ..... *H04R 3/04* (2013.01); *G10L 21/0232* (2013.01); *G10L 25/84* (2013.01); *G10L 25/90* (2013.01); *G10L 2021/02163* (2013.01); *H04R 2410/07* (2013.01)

(58) Field of Classification Search
CPC .... H03G 3/005; H03G 3/32; G10K 11/17821; G10K 11/17823; G10K 11/17873; G10K 2210/1081; G10K 2210/12821; G10K 2210/3045; G10K 2210/3046; G10K 2210/3221; H04R 3/04; H04R 2410/07; G10L 21/0232; G10L 25/84; G10L 25/90; G10L 2021/02163
USPC ..... 381/57, 71.2, 71.13, 71.4, 94.1–94.9
See application file for complete search history.

(56) References Cited

U.S. PATENT DOCUMENTS

| | | | | |
|---|---|---|---|---|
| 7,760,888 | B2 * | 7/2010 | Kanamori ..... | H04R 3/02 381/83 |
| 7,885,420 | B2 | 2/2011 | Hetherington et al. | |
| 8,433,564 | B2 | 4/2013 | Konchitsky et al. | |
| 8,509,451 | B2 * | 8/2013 | Hayakawa ..... | G10L 21/0208 381/104 |
| 8,600,073 | B2 | 12/2013 | Sun | |

(Continued)

FOREIGN PATENT DOCUMENTS

KR 10-2016-0050186 A 5/2016

*Primary Examiner* — Xu Mei
(74) *Attorney, Agent, or Firm* — Harness, Dickey & Pierce, P.L.C.

(57) ABSTRACT

A method of suppressing wind noise of a microphone and/or an electronic device are disclosed. The method of suppressing wind noise of a microphone includes receiving an audio signal, obtaining a frequency spectrum of the audio signal and a power spectrum of the audio signal, determining a wind noise power spectrum of the audio signal based on the power spectrum, determining a wind noise suppression gain based on the wind noise power spectrum and the power spectrum, correcting the frequency spectrum according to the determined wind noise suppression gain, and converting the corrected frequency spectrum into a time domain to obtain a corrected audio signal.

20 Claims, 3 Drawing Sheets

(56) References Cited

U.S. PATENT DOCUMENTS

| | | | | |
|---|---|---|---|---|
| 8,914,282 | B2 * | 12/2014 | Konchitsky | G10L 21/0208 704/226 |
| 9,124,962 | B2 | 9/2015 | Saito | |
| 10,582,293 | B2 * | 3/2020 | Yamkovoy | G10K 11/178 |
| 2006/0120540 | A1 * | 6/2006 | Luo | H04R 25/407 381/98 |
| 2008/0317261 | A1 * | 12/2008 | Yoshida | H04R 3/04 381/94.1 |
| 2015/0189432 | A1 * | 7/2015 | Yuzuriha | H04R 3/00 381/94.1 |
| 2021/0065670 | A1 | 3/2021 | Unruh et al. | |

* cited by examiner

500

METHOD OF SUPPRESSING WIND NOISE OF MICROPHONE AND ELECTRONIC DEVICE

CROSS-REFERENCE TO RELATED APPLICATION

This application is based on and claims the benefit of priority under 35 U.S.C. § 119 to Chinese Patent Application No. 202111116519.2, filed Sep. 23, 2021, in the China National Intellectual Property Administration, the disclosure of which is incorporated by reference herein in its entirety.

BACKGROUND

Some example embodiments relate to audio processing, and more particularly, to a method of suppressing wind noise of microphone and/or an electronic device.

With the development of technology, portable terminals are widely used. Many portable terminals support audio collection functions. The portable terminals can collect audio signals through a microphone, and then process the collected audio signals. However, when the audio signal is collected through a microphone, when there is wind in the external environment, the audio signal may sometimes unavoidably be affected by wind noise, which may affect the quality of the collected audio signal.

Therefore, a technique for suppressing or reducing wind noise of microphones is being pursued.

SUMMARY

This summary is provided to introduce a selection of concepts in a simplified form that are further described below in the Detailed Description. This summary is not intended to identify key features and/or essential features of the claimed subject matter, nor is it intended to be used as an aid in determining the scope of the claimed subject matter.

According to some example embodiments, there is provided a method of suppressing wind noise of microphone including receiving an audio signal, obtaining a frequency spectrum of the audio signal and a power spectrum of the audio signal, determining a wind noise power spectrum of the audio signal based on the power spectrum, determining a wind noise suppression gain based on the wind noise power spectrum and the power spectrum, correcting the frequency spectrum according to the determined wind noise suppression gain, and converting the corrected frequency spectrum into a time domain to obtain a corrected audio signal.

The determining of the wind noise power spectrum of the audio signal based on the power spectrum may comprise, detecting a low-frequency energy from the power spectrum, wherein the low-frequency energy indicates energy of frequencies below a frequency corresponding to a pitch of the audio signal, determining an attenuation coefficient of each of frequency points in the power spectrum, and obtaining the wind noise power spectrum based on the low-frequency energy and the attenuation coefficient.

The determining of the attenuation coefficient of each frequency point in the power spectrum may comprise determining the attenuation coefficient of each frequency point based on a frequency of each frequency point and an attenuation factor such as a predetermined attenuation factor.

The attenuation coefficient of each frequency point may be expressed as a v-th negative power of the frequency of each frequency point, wherein, v indicates the attenuation factor.

The low-frequency energy may indicate at least one of a maximum energy among energy at frequency points below the frequency corresponding to the pitch, an average value of energy at frequency points below the frequency corresponding to the pitch, and a sum of energy at frequency points below the frequency corresponding to the pitch.

The method may further comprise detecting presence of wind noise and voice in the audio signal, wherein the detecting of the low-frequency energy from the power spectrum comprises determining the low-frequency energy in the power spectrum based on a result of the detecting the presence of wind noise and voice.

The detecting of the low-frequency energy from the power spectrum may comprise, in response to both wind noise and voice being detected in the audio signal, the low-frequency energy indicates a maximum energy among energy at frequency points below the frequency corresponding to the pitch and/or an average value of energy at frequency points below the frequency corresponding to the pitch, and in response to only wind noise being detected in the audio signal and not voice being detected in the collected audio signal, the low-frequency energy indicates a sum of energy at frequency points below the frequency corresponding to the pitch.

The method may further comprise detecting the pitch from the audio signal.

The wind noise power spectrum may be obtained by multiplying the low-frequency energy by the attenuation coefficient.

The determining of the wind noise suppression gain may comprise estimating an a posteriori signal-to-noise ratio (SNR) according to the wind noise power spectrum and the power spectrum, estimating an a priori SNR based on the a posteriori SNR, and calculating the wind noise suppression gain based on the a priori SNR.

The calculating of the wind noise suppression gain based on the a priori SNR may comprise calculating a ratio of the a priori SNR to (the priori SNR+1) as the wind noise suppression gain.

The method may further comprise smoothing a low-frequency energy detected in a current frame of the audio signal based on a low-frequency energy in a previous frame of the audio signal.

According to some example embodiments, there is provided an electronic device comprising, a microphone configured to collect an audio signal, and an audio processor configured to obtain a frequency spectrum and a power spectrum of the audio signal. The audio processor determines a wind noise power spectrum of the audio signal based on the power spectrum, determines a wind noise suppression gain based on the wind noise power spectrum and the power spectrum, corrects the frequency spectrum according to the determined wind noise suppression gain, and converts the corrected frequency spectrum into a time domain to obtain a corrected audio signal. The electronic device may further comprise a speaker configured to output the corrected audio signal.

The audio processor may be configured to detect a low-frequency energy from the power spectrum, wherein the low-frequency energy indicates energy of frequencies below a frequency corresponding to a pitch of the audio signal, determine an attenuation coefficient of each of frequency points in the power spectrum, and obtain the wind noise power spectrum based on the low-frequency energy and the attenuation coefficient.

The audio processor may be configured to determine the attenuation coefficient of each frequency point based on a frequency of each frequency point and a predetermined attenuation factor.

The attenuation coefficient of each frequency point may be expressed as a v-th negative power of the frequency of each frequency point, wherein, v indicates the predetermined attenuation factor.

The low-frequency energy may indicate at least one of a maximum energy among energy at frequency points below the frequency corresponding to the pitch, an average value of energy at frequency points below the frequency corresponding to the pitch, or a sum of energy at frequency points below the frequency corresponding to the pitch.

The audio processor may be further configured to detect presence of wind noise and voice in the audio signal, and determine the low-frequency energy in the power spectrum based on a result of the detecting, wherein, when both wind noise and voice are detected in the audio signal, the low-frequency energy indicates a maximum energy among energy at frequency points below the frequency corresponding to the pitch or an average value of energy at frequency points below the frequency corresponding to the pitch; and in response to only wind noise being detected in the collected audio signal and no voice being detected in the collected audio signal, the low-frequency energy indicates a sum of energy at frequency points below the frequency corresponding to the pitch.

The audio processor may be further configured to detect the pitch from the audio signal.

The audio processor may be configured to obtain the wind noise power spectrum by multiplying the low-frequency energy by the attenuation coefficient.

The audio processor may be configured to estimate an posteriori signal-to-noise ratio (SNR) according to the wind noise power spectrum and the power spectrum, estimate an a priori SNR based on the posteriori SNR, and calculate the wind noise suppression gain based on the a priori SNR.

The audio processor may be configured to calculate a ratio of the a priori SNR to (the a priori SNR+1) as the wind noise suppression gain.

The audio processor may be further configured to smooth a low-frequency energy detected in a current frame of the audio signal based on a low-frequency energy in a previous frame of the audio signal.

According to some example embodiments, there is provided a non-transitory computer-readable storage medium storing instructions that, when executed by a processor, cause the processor to execute the method disclosed above.

The method of suppressing wind noise of microphone and the electronic device according to some example embodiments of inventive concepts may have better effect on the suppressing of wind noise.

Other aspects and/or advantages of inventive concepts will be partially described in the following description, and part will be clear through the description and/or may be learn through the practice of various example embodiments.

BRIEF DESCRIPTION OF THE DRAWINGS

The above and other objects, features and advantages of the present disclosure will become clearer through the following detailed description together with the accompanying drawings in which.

DETAILED DESCRIPTION OF EXAMPLE EMBODIMENTS

Figure 1:
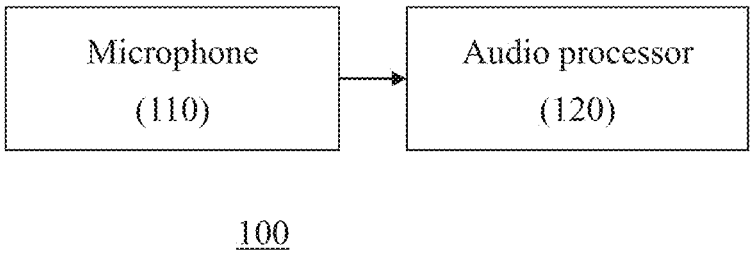
FIG. 1 is a block diagram showing an electronic device according to some example embodiments.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

The following structural or functional descriptions of examples disclosed herein are merely intended for the purpose of describing the examples and the examples may be implemented in various forms. The examples are not meant to be limited, but it is intended that various modifications, equivalents, and alternatives are also covered within the scope of the claims.

Although terms of "first" or "second" are used to explain various components, the components are not limited to the terms. These terms should be used only to distinguish one component from another component. For example, a "first" component may be referred to as a "second" component, or similarly, and the "second" component may be referred to as the "first" component within the scope of the right according to the concept of the present disclosure.

It will be understood that when a component is referred to as being "connected to" another component, the component can be directly connected or coupled to the other component or intervening components may be present.

As used herein, the singular forms "a", "an", and "the" are intended to include the plural forms as well, unless the context clearly indicates otherwise. It should be further understood that the terms "comprises" and/or "comprising," when used in this specification, specify the presence of stated features, integers, steps, operations, elements, components or a combination thereof, but do not preclude the presence or addition of one or more other features, integers, steps, operations, elements, components, and/or groups thereof.

Unless otherwise defined, all terms including technical or scientific terms used herein have the same meaning as commonly understood by one of ordinary skill in the art to which examples belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Hereinafter, examples will be described in detail with reference to the accompanying drawings. Regarding the reference numerals assigned to the elements in the drawings, it should be noted that the same elements will be designated by the same reference numerals, and redundant descriptions thereof will be omitted.

FIG. 1 is a block diagram showing an electronic device according to some example embodiments.

The electronic device according to various example embodiments may include, for example, at least one of a mobile phone, wireless headphone, recording pen, tablet personal computer (PC), personal digital assistant (PDA), portable multimedia player (PMP), augmented reality (AR) device, virtual reality (VR) device, various wearable devices (e.g. smart watch, smart glasses, smart bracelet, etc.). However, example embodiments are not limited to these, and the electronic device according to inventive concepts may be any electronic device having an audio collection function.

As shown in FIG. 1, the electronic device 100 according to some example embodiments of inventive concepts at least includes a microphone 110 and an audio processor 120.

The microphone 110 may collect sound from the outside, and may convert the collected sound into an electrical signal as an audio signal. Herein, the microphone 110 is a single microphone. Depending on the need and/or the design, the microphone 110 may output the audio signal in an analog form (e.g., as analog audio signal) and/or the audio signal in a digital form (e.g., digital audio signal).

The audio processor 120 may process the audio signal to perform a wind noise cancellation or wind noise reduction operation.

In a case where the microphone 110 outputs the audio signal in analog form, the audio processor 120 may convert the audio signal in an analog form received from the microphone 110 into the audio signal in a digital form. In a case where the microphone 110 outputs the audio signal in a digital form, the audio processor 120 may process or directly process the audio signal in digital form received from the microphone 110, e.g. the audio processor 120 may process the audio signal without basing the processing on an analog signal.

The audio processor 120 obtains a frequency spectrum and a power spectrum of the collected audio signal, determines a wind noise power spectrum of the collected audio signal based on the obtained power spectrum, determines a wind noise suppression gain based on the obtained wind noise power spectrum and the obtained power spectrum, corrects the frequency spectrum according to the determined wind noise suppression gain, and converts the corrected frequency spectrum into a time domain to obtain a corrected audio signal (e.g., an audio signal with wind noise eliminated). The audio processor 120 may output the corrected audio signal.

The audio processor 120 may be implemented as hardware such as general-purpose processor, application processor (AP), integrated circuit dedicated to audio processing, field programmable gate array, or a combination of hardware and software.

In some example embodiments, the electronic device 100 may also include a memory (not shown). The memory may store data and/or software for implementing a method of suppressing wind noise of microphone according to some example embodiments. When the audio processor 120 executes the software, the method of suppressing wind noise of microphone according to some example embodiments of inventive concepts may be implemented. In addition, the memory may also be used to store the corrected audio signal; however, example embodiments are not limited thereto, and the corrected audio signal may not be stored in the electronic device 100.

In some example embodiments, the microphone 110 and the audio processor 120 may be installed in different devices. For example, the microphone 110 may provide, through wired communication and/or wireless communication, the audio signal to the audio processor 120 for processing.

The method of suppressing wind noise of microphone according to some example embodiments of inventive concepts is described below in connection with FIG. 2.

Figure 2:
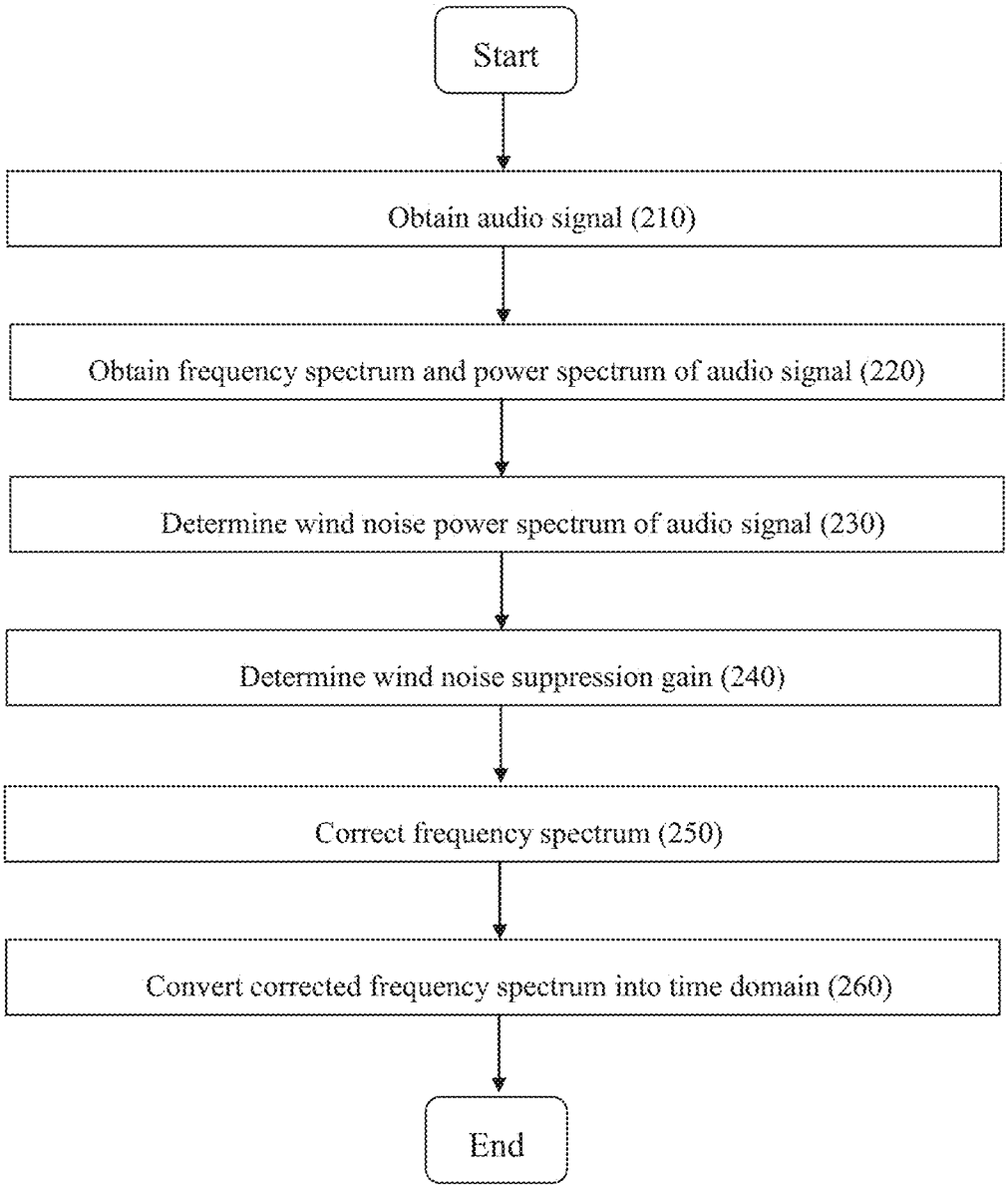
FIG. 2 is a flowchart illustrating a method of suppressing wind noise of microphone according to some example embodiments.

FIG. 2 is a flowchart showing the method of suppressing wind noise of microphone according to some example embodiments of inventive concepts. Although FIG. 2 illustrates various steps, an order of the steps is not necessarily limited to the order presented in FIG. 2.

Referring to FIG. 2, in step 210, the audio processor 120 receives an audio signal collected by the microphone 110.

In step 220, the audio processor 120 obtains the frequency spectrum and the power spectrum of the collected audio signal. For example, the frequency spectrum and/or the power spectrum of the collected audio signal may be obtained by a Fourier transform.

For example, the Fourier transform may be or correspond to at least one of a discrete Fourier transform, a fast Fourier transform, a discrete cosine transform, a discrete sine transform, or a wavelet transform. If the audio signal is obtained with an analog signal, an analog-to-digital converter (not shown) may convert the audio signal into a digital signal; however, example embodiments are not limited thereto.

In step 230, the audio processor 120 determines the wind noise power spectrum of the collected audio signal based on the power spectrum of the collected audio signal.

The audio processor 120 obtains the wind noise power spectrum according to low-frequency energy of the audio signal determined from the power spectrum, and according to an attenuation coefficient of each frequency point.

The process of determining the wind noise power spectrum of the collected audio signal will be described in more detail later in combination with FIG. 3.

In step 240, the audio processor 120 determines the wind noise suppression gain based on the wind noise power spectrum and the power spectrum.

The audio processor 120 may estimate a posteriori signal-to-noise ratio (SNR) of each frequency point and a priori SNR of each frequency point. The posteriori SNR and the prior SNR may be estimated according to the wind noise power spectrum and the power spectrum. The audio processor 120 may calculate the wind noise suppression gain of each of frequency points based on the priori SNR of each frequency point.

The process of determining the wind noise suppression gain will be described in detail later in connection with FIG. 4.

In step 250, the audio processor 120 corrects the frequency spectrum according to the determined wind noise suppression gain. For example, the audio processor 120 weighs the amplitude of each frequency point in the frequency spectrum using the wind noise suppression gain of each frequency point. For example, the audio processor 120 may multiply the amplitude of each frequency point in the frequency spectrum by the wind noise suppression gain of each frequency point, to correct the frequency spectrum.

In step 260, the audio processor 120 converts the corrected frequency spectrum into a time domain to obtain the corrected audio signal. For example, the audio processor 120 may perform an inverse Fourier transform on the corrected frequency spectrum to obtain a signal in time domain.

For example, the audio processor 120 may perform at least one of an inverse discrete Fourier transform, an inverse fast Fourier transform, an inverse discrete cosine transform, an inverse discrete sine transform, or an inverse wavelet transform; however, example embodiments are not limited thereto.

In some example embodiments, the collected audio signal may be divided into a plurality of frames (e.g., audio signals with fixed, variable, or predetermined period), the method of suppressing wind noise of microphone in FIG. 2 may be performed in units of a frame so as to correct each frame, and the corrected frames may be combined and/or overlapped to obtain the final audio signal.

Figure 3:
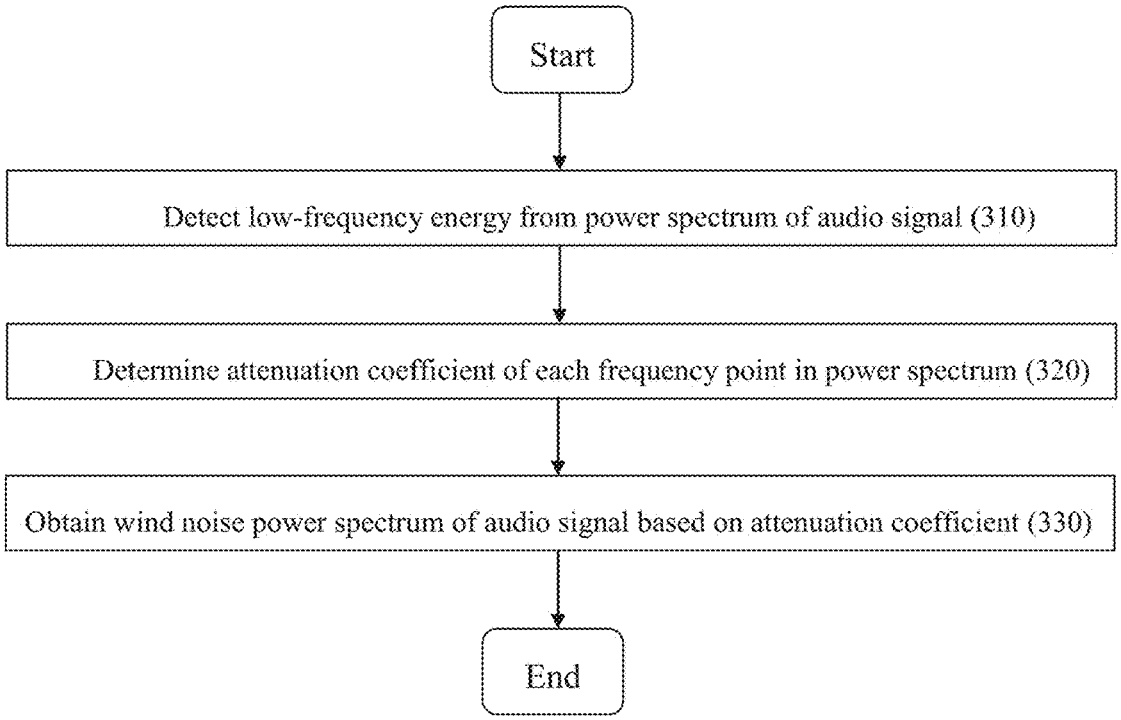
FIG. 3 shows a flowchart of a method for determining a wind noise power spectrum of collected audio signal according to some example embodiments.

FIG. 3 shows a flowchart of a method for determining the wind noise power spectrum of the collected audio signal according to some example embodiments.

In step 310, the audio processor 120 detects low-frequency energy from the power spectrum of the audio signal. The audio processor 120 may detect the pitch of the audio signal and then may detect the low-frequency energy or energies based on the frequency corresponding to the pitch (referred to as the frequency of the pitch). Herein, the low-frequency energy indicates the energy of the frequencies below the frequency corresponding to the pitch of the audio signal.

The detection of pitch of the audio signal may be realized by various pitch detection technologies and/or methods. For example, the pitch of the audio signal may be obtained through at least one of a zero crossing rate algorithm, an average magnitude difference function, an average squared mean difference function, and/or other autocorrelation algorithms and/or frequency domain approaches such as but not limited to harmonic product spectrum approaches, cepstral analysis, and/or maximum likelihood estimation analysis techniques.

In some example embodiments, the low-frequency energy may indicate or be based on at least one of a maximum energy among the energy at frequency points below the frequency corresponding to the pitch, an average value of the energy at frequency points below the frequency corresponding to the pitch, and a sum of the energy at frequency points below the frequency corresponding to the pitch.

As used, a "maximum energy" may refer to an energy corresponding to a local or global maximum. As used herein, an "average value of the energy" may correspond to an energy associated with a measure of central tendency, such as at least one of a mean, median, or mode energy at frequency points below the frequency corresponding to the pitch In some example embodiments, the audio processor 120 detects the presence of wind noise and voice in the collected audio signal (e.g., detects whether there is wind noise and/or voice in the collected audio signal), and determines the low-frequency energy based on the detection result.

For example, when both wind noise and voice are detected in the collected audio signal, the maximum energy among the energy at frequency points below the frequency corresponding to the pitch and/or the average value of the energy at frequency points below the frequency corresponding to the pitch, and/or a function thereof, is selected as the low-frequency energy. For example, when both wind noise and voice are detected in the collected audio signal, the low-frequency energy indicates the maximum energy among the energy at frequency points below the frequency corresponding to the pitch, and/or the average value of the energy at frequency points below the frequency corresponding to the pitch.

When only wind noise (and no voice) is detected in the collected audio signal, the sum of the energy at frequency points below the frequency corresponding to the pitch is selected as the low-frequency energy. For example, when only wind noise is detected in the collected audio signal, the low-frequency energy indicates the sum of energy at frequency points below the frequency corresponding to the pitch.

In some example embodiments, the presence of the wind noise in the audio signal may be detected according to at least one of the zero crossing rate of the audio signal in time domain, the sub-band centroid (or referred to as the sub-band spectral centroid) of the audio signal, and the low-frequency band energy of the audio signal (e.g. the energy of a fixed, variable, or predetermined frequency band whose upper limit is less than the first threshold). For example, when the zero crossing rate, the sub-band centroid and the low-frequency band energy are greater than the respective thresholds, it is determined that there is wind noise in the audio signal. However, example embodiments are not limited to this, and whether there is wind noise in the audio signal may be detected by other various wind noise detection techniques.

In some example embodiments, the presence of voice in the audio signal may be detected according to at least one of the high-frequency band energy of the audio signal (e.g. the energy of a fixed, variable, or predetermined frequency band whose lower limit is greater than the second threshold, and the first threshold is less than the second threshold) and the high-frequency band energy ratio (e.g., the ratio of high-frequency band energy to total energy). For example, when the high-frequency band energy and the high-frequency band energy ratio are greater than their respective thresholds, it is determined that there is voice in the audio signal. However, example embodiments are not limited to this, and whether there is voice in the audio signal may be detected by other voice activity detection techniques.

In step 320, the audio processor 120 determines the attenuation coefficient of each frequency point in the power spectrum.

The audio processor 120 may determine the attenuation coefficient of each frequency point based on the frequency of each frequency point in the power spectrum and a fixed, variable, or predetermined attenuation factor. For example, the attenuation factor may be determined before and/or fixed before obtaining an audio signal; however, example embodiments are not limited thereto.

The attenuation coefficient of each frequency point is expressed as or corresponds to the v-th negative power of the frequency of each frequency point, for example, $1/f^{v}$. Here, f indicates the frequency of the frequency point, and v indicates the fixed, variable, or predetermined attenuation factor.

In step 330, the audio processor 120 obtains the wind noise power spectrum of the audio signal based on the low-frequency energy determined in step 310 and on the attenuation coefficient determined in step 320.

The wind noise power spectrum may be obtained by multiplying the low-frequency energy by the attenuation coefficient of each frequency point. For example, in a case where the method of suppressing wind noise is performed in units of a frame, the wind noise power spectrum may be expressed as the following equation (1):

$$\Phi(\lambda,\mu)=\beta(\lambda)\cdot f(\lambda,\mu)^{-v}. \quad (1)$$

Herein, $\Phi(\lambda,\mu)$ indicates the wind noise power of the μ-th frequency point of the λ-th frame of the audio signal, $\beta(\lambda)$ indicates the low frequency energy of the λ-th frame of the audio signal, $f(\lambda,\mu)$ indicates the frequency of the μ-th frequency point of the λ-th frame of the audio signal point, and v indicates the fixed, variable, or predetermined attenuation factor.

According to the method of determining the wind noise power spectrum of the collected audio signal according to some example embodiments of inventive concepts, the wind noise power spectrum may be estimated more accurately.

Figure 4:
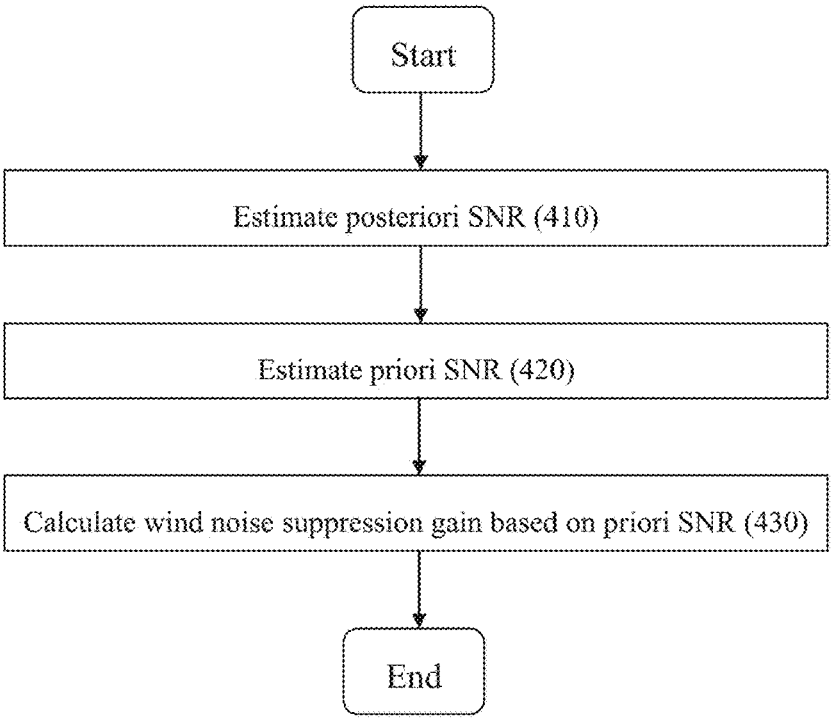
FIG. 4 shows a flowchart of a method for determining a wind noise suppression gain according to some example embodiments.

FIG. 4 shows a flowchart of a method for determining a wind noise suppression gain according to some example embodiments.

In step 410, the audio processor 120 estimates the posteriori SNR according to the wind noise power spectrum and the power spectrum.

The audio processor 120 may estimate the posteriori SNR of each frequency point using the power of each frequency point in the wind noise power spectrum and using the power of each frequency point in the power spectrum. The posterior SNR of each frequency point may be expressed as the following equation (2):

$$\gamma(\lambda,\mu) \triangleq \frac{E(\lambda,\mu)}{\Phi(\lambda,\mu)}. \quad (2)$$

Herein, $\gamma(\lambda,\mu)$ indicates the posteriori SNR of frequency point (for example, the μ-th frequency point of the λ-th frame of audio signal), $E(\lambda,\mu)$ indicates the power of the frequency point (for example, the μ-th frequency point of the λ-th frame of the audio signal), and $\Phi(\lambda,\mu)$ indicates the wind noise power of the frequency point (for example, the μ-th frequency point of the λ-th frame of the audio signal).

In step 420, the audio processor 120 estimates the a priori SNR based on the a posteriori SNR.

The audio processor 120 may estimate the priori SNR of each frequency point based on the posteriori SNR of each frequency point.

In some example embodiments, the priori SNR of each frequency point may be expressed as the following equation (3):

$$\xi(\lambda,\mu)=\min(\max(\gamma(\lambda,\mu)-1,0),\xi_{min}). \quad (3)$$

Herein, $\xi(\lambda,\mu)$ indicates the priori SNR of the frequency point (for example, the μ-th frequency point of the λ-th frame of audio signal), and $\xi_{min}$ indicates a variable, fixed, or predetermined minimum a priori SNR.

It should be understood that as used herein, the scheme for estimating the priori SNR is not limited to equation (3), and other schemes for estimating the priori SNR may also be used to estimate the priori SNR based on the posteriori SNR.

In step 430, the audio processor 120 calculates the wind noise suppression gain based on the priori SNR.

The audio processor 120 may calculate the wind noise suppression gain of each frequency point based on the priori SNR of each frequency point. For example, a ratio of the priori SNR to (the priori SNR+1) may be used as or may correspond to the wind noise suppression gain. The wind noise suppression gain of each frequency point may be expressed as the following equation (4):

$$G(\lambda,\mu) = \frac{\xi(\lambda,\mu)}{1+\xi(\lambda,\mu)}. \quad (4)$$

Herein, $G(\lambda,\mu)$ indicates the wind noise suppression gain of the frequency point (for example, the μ-th frequency point of the λ-th frame of audio signal).

According to the method for suppressing wind noise based on some example embodiments of inventive concepts, since the low-frequency energy in the audio signal is determined considering the existence of wind noise and/or voice in the audio signal, and the wind noise power spectrum and wind noise suppression gain are calculated accordingly, the wind noise may be suppressed to the better, e.g. to the greatest extent, and/or an audio signal may be generated and/or output, while ensuring or helping to ensure the voice quality.

In some example embodiments, in a case where the method of suppressing wind noise is performed in units of a frame, the audio processor 120 smooths the low-frequency energy detected in the current frame of the audio signal based on the low-frequency energy in the previous frame of the audio signal, and performs subsequent steps using the smoothed low-frequency energy, instead of the unsmoothed low-frequency energy (e/g., in the steps in FIGS. 2-4, smoothed low-frequency energy instead of non-smoothed low-frequency energy is adopted). For example, inter-frame smoothing may be performed according to or based on the following equation (5):

$$\hat{\beta}(\lambda)=\alpha\cdot\hat{\beta}(\lambda-1)+(1-\alpha)\cdot\beta(\lambda). \quad (5)$$

Herein, $\hat{\beta}(\lambda)$ indicates the smoothed low frequency energy of the λ-th frame of the audio signal, $\hat{\beta}(\lambda-1)$ indicates the smoothed low frequency energy of the (λ−1)-th frame of the audio signal, a indicates a smoothing coefficient, and $0<\alpha<1$.

Figure 5:
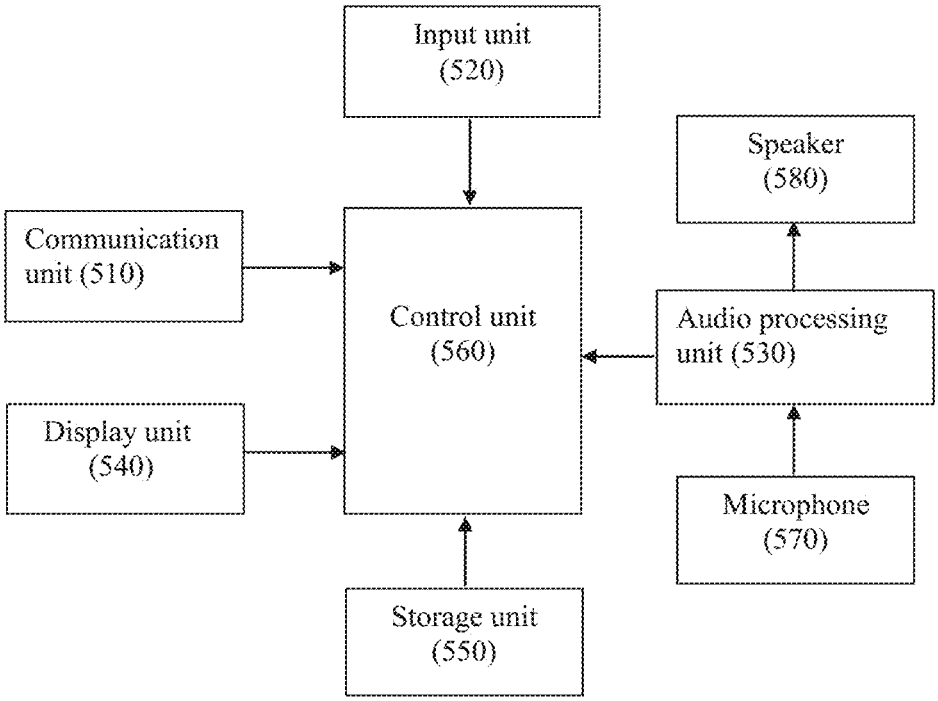
FIG. 5 shows a block diagram of a mobile terminal according to some example embodiments.

FIG. 5 shows a block diagram of a mobile terminal according to some example embodiments.

As shown in FIG. 5, the mobile terminal 500 according to some example embodiments of inventive concepts includes a communication unit 510, an input unit 520, an audio processing unit 530, a display unit 540, a storage unit 550, a control unit 560, a microphone 570, and a speaker 580.

The communication unit 510 may perform a communication operation for the mobile terminal. The communication unit 510 may establish a communication channel to the communication network and/or may perform communication associated with, for example, a voice call, a video call, and/or a data call.

The input unit 520 is configured to receive various input information and various control signals, and to transmit the input information and control signals to the control unit 560. The input unit 520 may be realized by various input devices such as keypads and/or key boards, touch screens and/or styluses, mice, etc.; however, example embodiments are not limited thereto.

The audio processing unit 530 is connected to the microphone 570 and the speaker 580. The microphone 570 is used to collect external audio signals, for example, during calls and/or sound recording. The audio processing unit 530 processes the audio signal collected by the microphone 570 (for example, using the method of suppressing the wind noise of the microphone shown in FIG. 2), and transmits the processed audio signal to the control unit 560. The control unit 560 may transmit the processed audio signal in digital form via the communication unit 510 and/or may store the processed audio signal in the storage unit 550. The audio processing unit 530 converts the digital audio signal from the control unit 560 into an analog audio signal for outputting to the outside through the speaker 580. The audio processing unit 530 may be similar to the audio processor 120 of FIG. 1.

The display unit 540 is used to display various information and may be realized, for example, by a touch screen; however, example embodiments are not limited thereto.

The storage unit 550 may include volatile memory and/or nonvolatile memory. The storage unit 550 may store various data generated and used by the mobile terminal. For example, the storage unit 550 may store an operating system (OS) and applications (e.g. applications associated with the method of inventive concepts) for controlling the operation of the mobile terminal. The control unit 560 may control the overall operation of the mobile terminal and may control part or all of the internal elements of the mobile terminal. The control unit 560 may be implemented as general-purpose processor, application processor (AP), application specific integrated circuit, field programmable gate array, etc., but example embodiments are not limited thereto.

In some example embodiments, the audio processing unit 530 and the control unit 560 may be implemented by the same device and/or integrated in a single chip.

The apparatuses, units, modules, devices, and other components described herein are implemented by hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

The methods that perform the operations described in this application are performed by computing hardware, for example, by one or more processors or computers, implemented as described above executing instructions or software to perform the operations described in this application that are performed by the methods. For example, a single operation or two or more operations may be performed by a single processor, or two or more processors, or a processor and a controller. One or more operations may be performed by one or more processors, or a processor and a controller, and one or more other operations may be performed by one or more other processors, or another processor and another controller. One or more processors, or a processor and a controller, may perform a single operation, or two or more operations.

Instructions or software to control a processor or computer to implement the hardware components and perform the methods as described above are written as computer programs, code segments, instructions or any combination thereof, for individually or collectively instructing or configuring the processor or computer to operate as a machine or special-purpose computer to perform the operations performed by the hardware components and the methods as described above. In one example, the instructions and/or software include machine code that is directly executed by the processor or computer, such as machine code produced by a compiler. In another example, the instructions or software include higher-level code that is executed by the processor or computer using an interpreter. Persons and/or programmers of ordinary skill in the art may readily write the instructions and/or software based on the block diagrams and the flow charts illustrated in the drawings and the corresponding descriptions in the specification, which disclose algorithms for performing the operations performed by the hardware components and the methods as described above.

The instructions or software to control a processor or computer to implement the hardware components and perform the methods as described above, and any associated data, data files, and data structures, are recorded, stored, or fixed in or on one or more non-transitory computer-readable storage media. Examples of a non-transitory computer-readable storage medium include at least one of read-only memory (ROM), random-access programmable read only memory (PROM), electrically erasable programmable read-only memory (EEPROM), random-access memory (RAM), dynamic random access memory (DRAM), static random access memory (SRAM), flash memory, non-volatile memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, blue-ray or optical disk storage, hard disk drive (HDD), solid state drive (SSD), flash memory, a card type memory such as multimedia card or a micro card (for example, secure digital (SD) or extreme digital (XD)), magnetic tapes, floppy disks, magneto-optical data storage devices, optical data storage devices, hard disks, solid-state disks, and any other device that is configured to store the instructions or software and any associated data, data files, and data structures in a non-transitory manner and providing the instructions or software and any associated data, data files, and data structures to a processor or computer so that the processor or computer can execute the instructions.

As used herein, at least some of the elements described herein may be implemented in processing circuitry such as hardware including logic circuits; a hardware/software combination such as a processor executing software; or a combination thereof. For example, the processing circuitry more specifically may include, but is not limited to, a central processing unit (CPU), an arithmetic logic unit (ALU), a digital signal processor, a microcomputer, a field programmable gate array (FPGA), a System-on-Chip (SoC), a programmable logic unit, a microprocessor, application-specific integrated circuit (ASIC), etc.

While various example embodiments have been described, it will be apparent to one of ordinary skill in the art that various changes in form and details may be made in these examples without departing from the spirit and scope of the claims and their equivalents.

What is claimed is:

1. A method of suppressing wind noise of a microphone comprising:

receiving an audio signal;

obtaining a frequency spectrum of the audio signal and obtaining a power spectrum of the audio signal;

determining a wind noise power spectrum of the audio signal based on the power spectrum;

determining a wind noise suppression gain based on the wind noise power spectrum and on the power spectrum;

correcting the frequency spectrum according to the determined wind noise suppression gain; and converting the corrected frequency spectrum into a time domain to obtain a corrected audio signal.

2. The method of claim 1, wherein, the determining of the wind noise power spectrum of the audio signal based on the power spectrum comprises:

detecting a low-frequency energy from the power spectrum, wherein the low-frequency energy indicates energy of frequencies below a frequency corresponding to a pitch of the audio signal;

determining an attenuation coefficient of each of frequency points in the power spectrum; and obtaining the wind noise power spectrum based on the low-frequency energy and the attenuation coefficient.

3. The method of claim 2, wherein the determining of the attenuation coefficient of each frequency point in the power spectrum comprises determining the attenuation coefficient of each frequency point based on a frequency of each frequency point and on an attenuation factor.

4. The method of claim 2, wherein the attenuation coefficient of each frequency point is expressed as a v-th negative power of the frequency of each frequency point, wherein v indicates an attenuation factor.

5. The method of claim 2, wherein, the low-frequency energy corresponds to at least one of a maximum energy among energy at frequency points below the frequency corresponding to the pitch, an average value of energy at frequency points below the frequency corresponding to the pitch, or a sum of energy at frequency points below the frequency corresponding to the pitch.

6. The method of claim 2, further comprises:

detecting presence of wind noise in the audio signal and voice in the audio signal, wherein the detecting of the low-frequency energy from the power spectrum comprises determining the low-frequency energy in the power spectrum based on a result of the detecting the presence of wind noise and voice.

7. The method of claim 6, wherein the detecting of the low-frequency energy from the power spectrum comprises:

in response to both wind noise and voice being detected in the audio signal, the low-frequency energy indicates at least one of a maximum energy among energy at frequency points below the frequency corresponding to the pitch or an average value of energy at frequency points below the frequency corresponding to the pitch, and in response to wind noise being detected in the audio signal and voice not being detected in the audio signal, the low-frequency energy indicates a sum of energy at frequency points below the frequency corresponding to the pitch.

8. The method of claim 2, further comprising:

detecting the pitch from the audio signal.

9. The method of claim 2, wherein the wind noise power spectrum is obtained based on a multiplication of the low-frequency energy by the attenuation coefficient.

10. The method of claim 1, wherein the determining of the wind noise suppression gain comprises:

estimating a posteriori signal-to-noise ratio (SNR) according to the wind noise power spectrum and the power spectrum;

estimating a priori SNR based on the posteriori SNR; and calculating the wind noise suppression gain based on the a priori SNR.

11. The method of claim 10, wherein the calculating of the wind noise suppression gain based on the priori SNR comprises:

calculating the wind noise suppression gain based on a ratio of the priori SNR to (the a priori SNR+1).

12. The method of claim 2, further comprising:

smoothing a low-frequency energy detected in a current frame of the audio signal based on a low-frequency energy in a previous frame of the audio signal.

13. An electronic device comprising:

a microphone configured to collect an audio signal; and an audio processor configured to, obtain a frequency spectrum of the audio signal and obtain a power spectrum of the audio signal, determine a wind noise power spectrum of the audio signal based on the power spectrum, determine a wind noise suppression gain based on the wind noise power spectrum and on the power spectrum, correct the frequency spectrum according to the determined wind noise suppression gain, and convert the corrected frequency spectrum into a time domain to obtain a corrected audio signal.

14. The electronic device of claim 13, wherein the audio processor is configured to detect a low-frequency energy from the power spectrum, wherein the low-frequency energy corresponds to energy of frequencies below a frequency corresponding to a pitch of the audio signal;

determine an attenuation coefficient of each of frequency points in the power spectrum; and obtain the wind noise power spectrum based on the low-frequency energy and the attenuation coefficient.

15. The electronic device of claim 14, wherein the audio processor is configured to determine the attenuation coefficient of each frequency point based on a frequency of each frequency point and an attenuation factor.

16. The electronic device of claim 14, wherein the attenuation coefficient of each frequency point corresponds to v-th negative power of the frequency of each frequency point, wherein v indicates an attenuation factor.

17. The electronic device of claim 14, wherein the low-frequency energy corresponds to at least one of a maximum energy among energy at frequency points below the frequency corresponding to the pitch, an average value of energy at frequency points below the frequency corresponding to the pitch, or a sum of energy at frequency points below the frequency corresponding to the pitch.

18. The electronic device of claim 14, wherein the audio processor is further configured to detect presence of wind noise in the audio signal and voice in the audio signal; and determine the low-frequency energy in the power spectrum based on a result of the detecting the presence of wind noise and voice.

19. The electronic device of claim 18, wherein, in response to both wind noise and voice being detected in the audio signal, the low-frequency energy corresponds to a maximum energy among energy at frequency points below the frequency corresponding to the pitch or an average value of energy at frequency points below the frequency corresponding to the pitch, and in response to the wind noise being detected in the collected audio signal and voice not being detected in the collected audio signal, the low-frequency energy corresponds to a sum of energy at frequency points below the frequency corresponding to the pitch.

20. The electronic device of claim 14, wherein the audio processor is further configured to detect the pitch from the audio signal.

* * * * *